US005387167A

United States Patent [19]

Johnston

[11] Patent Number: 5,387,167

[45] Date of Patent: Feb. 7, 1995

[54] FOOT OPERATED ROTATIONAL ASSEMBLY

[76] Inventor: Gary L. Johnston, P.O. Box 183, Cowarts, Ala. 36321

[21] Appl. No.: 136,102

[22] Filed: Oct. 13, 1993

Related U.S. Application Data

[63] Continuation-in-part of Ser. No. 970,168, Nov. 2, 1992.

[51] Int. Cl.[6] ..... A63B 21/00

[52] U.S. Cl. ..... 482/57; 482/51

[58] Field of Search ..... 482/57, 51, 148; 601/23, 27, 34, 35, 36

[56] References Cited

U.S. PATENT DOCUMENTS 4,643,419 2/1987 Hyde ..... 482/57
4,779,863 10/1988 Yang ..... 482/57
4,786,050 11/1988 Geschwender ..... 482/57

*Primary Examiner*—Stephen R. Crow

[57] ABSTRACT

A foot operated rotational assembly is provided which a user operates while in a standing position. The apparatus includes a rotational assembly mounted on a frame structure. The rotational assembly includes a plurality of rotatable members connected together by an intermediate rotatable member. Cranks are attached to and extend from each side of the rotatable members. A pedal is located on each side which bridges the cranks on that side. The cranks are arranged so that the pedals are opposingly positioned and travel their path of rotation while remaining in a horizontal position.

3 Claims, 3 Drawing Sheets

FOOT OPERATED ROTATIONAL ASSEMBLY

CONTINUATION-IN-PART

This application is intended as a continuation-in-part to a previously filed application having the title "Stationary Exercise Apparatus" and having been assigned the Ser. No. 07/970,168, filed Nov. 2, 1992, now pending.

BACKGROUND OF THE INVENTION

This invention relates to a lower body exercise device and in particular to a stationary device which has an upright structure which allows the user to perform pedaling routines while in a standing position. This feature allows for a more overall lower body workout than provided by more conventional stationary lower body exercise devices such as cycles, treadmills, stair-stepper devices, and skiing or glider devices.

As may be seen, there already exists many variations of stationary upright lower body exercise devices. While these units offer a relatively good exercise, they all appear to be one dimensional. Most current cycling devices utilize a seat means, and those that do allow for pedaling in a standing position are not very easy to operates due to difficulties with the user keeping good balance. Current stair-stepper exercise devices and glider or skiing devices allow for very little rotary motion in the hips and stomach area. The stair-steppers allow for upward and downward motion in the user while glider or skiing devices allow for backward and forward motion in the user. Treadmills do provide for rotary motion in the hips and stomach, but forces act against the user only as the user steps on the treadmill base. This new exercise device provides a force against the user during upward, downward, backward, and forward leg motion, and therefore much more rotary motion in the hip and stomach area. Given the fact that there are a vast number of exercise devices, in particular pedaling type devices, it has come as a surprise that no one has effectively designed a device which may be easily operated from a standing position. The standing position provides a greater overall lower body workout than other pedaling type devices.

SUMMARY AND OBJECTS OF THE INVENTION

It is the object of this invention to provide a foot operated rotational assembly which supports the user while in an upright standing position and allows the user to perform cycling routines while in this position. The main purpose of this application is to demonstrate the different types of foot operated rotational assemblies which may be used for this purpose.

Briefly state, the apparatus that forms the basis of the present invention comprises basically foot engaging means and a rotational assembly means, although in one version of the assembly the rotational assembly means is not required. These will mount in some manner upon an overall frame structure.

The design of the foot operated rotational assembly is such that the foot support members of the foot engaging means, upon which the user places their feet, always remain in a substantially horizontal position as they move along their path of rotation. This feature is not found in other pedaling devices. The ability of the foot support member to maintain this substantially horizontal position may be due to a rotational assembly means, which may also be part of the foot operated rotational assembly.

Additional types of assemblies such as a resistance means, a motor means, and an upper body workout means may connect with the foot operated rotational assembly to create different types of exercise devices. These may be individually connected to used in combination with one another.

Other objects, features, and advantages for this invention will be apparent from the following detailed description and the appended claims, references being made to the accompanying drawings forming a part of the specification, wherein like reference numerals designate corresponding parts of the several views.

DETAILED DESCRIPTION OF THE PREFERRED EMBODIMENT

Figure 1B:
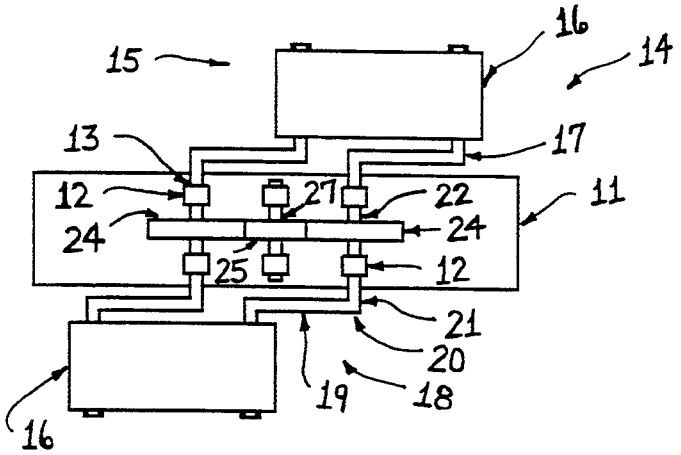
FIG. 1B is a top view of the first version.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

As best can be seen by references to the drawings, and in particular to FIGS. 1A thru 3C, the foot operated rotational assembly that forms the basis of the present invention is designated generally by the reference numeral 14, and includes a foot engaging means 15 and a may contain a rotational assembly means 23. This foot operated rotational assembly 14 mounts upon a frame structure 11 which may have upwardly extending assembly supports 12. These assembly supports 12 may contain structure openings 13, through which the foot operated rotational assembly 14 mounts.

As may also be seen, the foot engaging means 15 comprise foot support members 16, connected members 18, and shaft members 22. Shaft members 22 may mount through structure openings 13 of assembly supports 12, with a portion of shaft member 22 extending outside of assembly supports 12. Connection member 18 is a generally L-shaped rod element having a first leg 19 and a second leg 21. The angle between the two legs is preferred to be 90 degrees, but does not necessarily have to be. At the end of first leg 19 is shaft opening 20, which receives shaft member 22, and may be fixedly coupled together through a bolt, weld, or the like. Therefore shaft member 22 and connection member 18 rotate simultaneously. Foot support member 16 is a relatively flat structure upon which the user places their foot. It contains tubular opening 17 through the side which loosely receives the second leg 21 of connection member 18. Second leg 21 has a threaded end so a bolt nut member may be attached to keep foot support member 16 in position.

Also part of the foot operated rotational assembly may be a rotational assembly means 23. It enables the foot support members 25 of foot engaging means 15 to maintain a substantially horizontal position as they move around their path of rotation. In order to achieve this, shaft members 22 of foot engaging means 15 must rotate in the same direction and at the same angular velocity and acceleration.

Figure 1A:
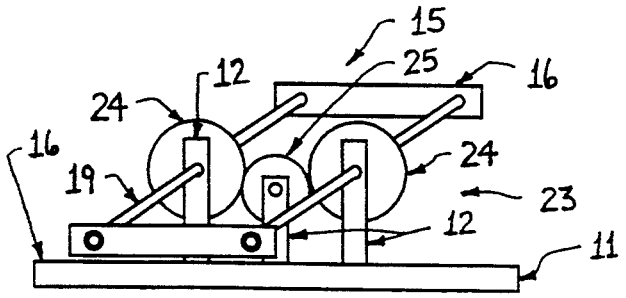
FIG. 1A is a side view of a first version of a foot operated rotational assembly.
Figure 1C:
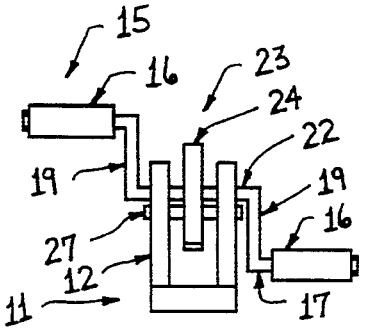
FIG. 1C is a front view of the first version.

Shown in FIGS. 1A, 1B, and 1C is one type of rotational assembly means 23. In this version, there are rotatable members 234 which fixedly mount on shaft members 22. An intermediate rotatable member 25 can mount fixedly or loosely upon an intermediate shaft member 27, which mounts to an additional assembly support 12. This intermediate rotatable members 25 is in direct rotating contact with rotatable members 24. This intermediate rotatable member 25 keeps rotatable members 24 rotating in the same direction and at the same angular velocity and acceleration, as long as the rotatable members 24 are the same size. This is a typical gear type assembly means, such as rotating gears with interfacing teeth or roller members with enough friction between surfaces so that no slippage occurs.

Figure 2B:
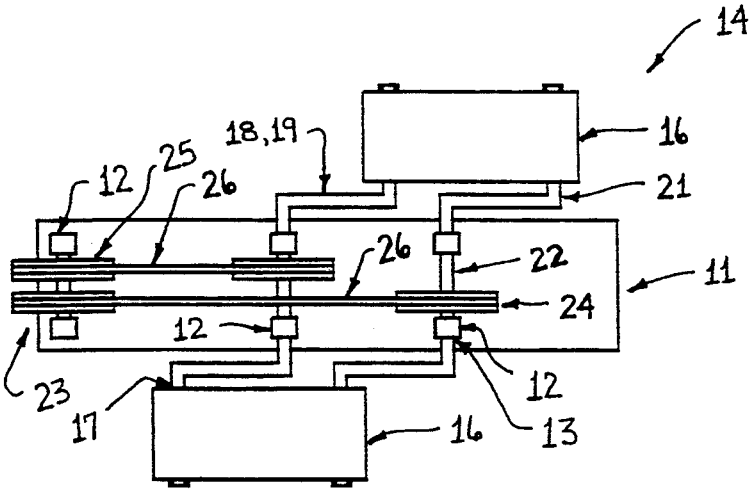
FIG. 2B is a top view of the second version.
Figure 2A:
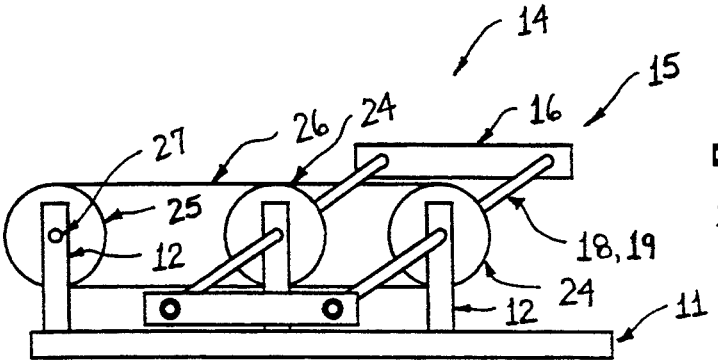
FIG. 2A is a side view of a second version of the foot operated rotational assembly.
Figure 2C:
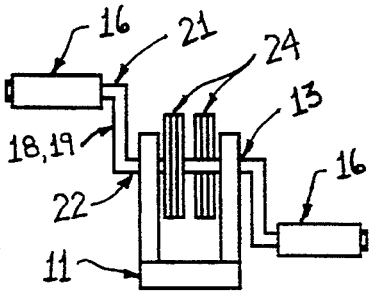
FIG. 2C is a front view of the second version.

Shown in FIGS. 2A, 2B, and 2C is a second version of the rotational assembly means 23. In this version, there are again rotatable members 24 which are fixedly mounted on shaft members 22. There are also two intermediate rotatable members 25 mounted fixedly or loosely upon intermediate shaft member 27, which also mounts on an assembly support 12. These intermediate rotatable members 25 are not in direct contact with rotatable members 21, but use closed loop interconnection members 26 to keep rotatable members 24 rotating in the same direction and at the same angular velocity and acceleration, as long as rotatable members 24 are the same size. The rotatable members, intermediate rotatable members, and interconnection members may be a typical chain and sprocket assembly.

Figure 3B:
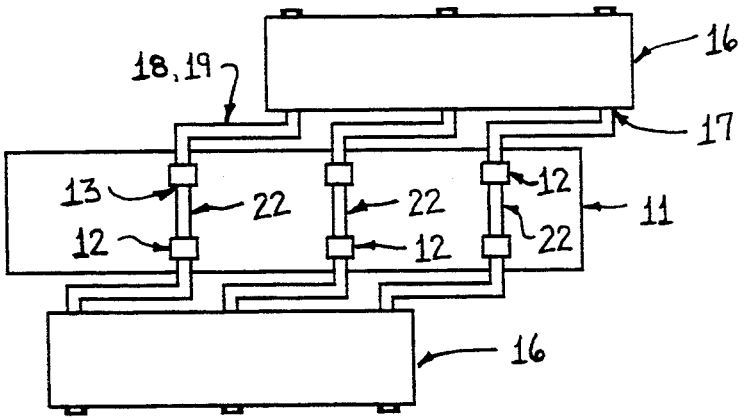
FIG. 3B is a top view of the third version.
Figure 3A:
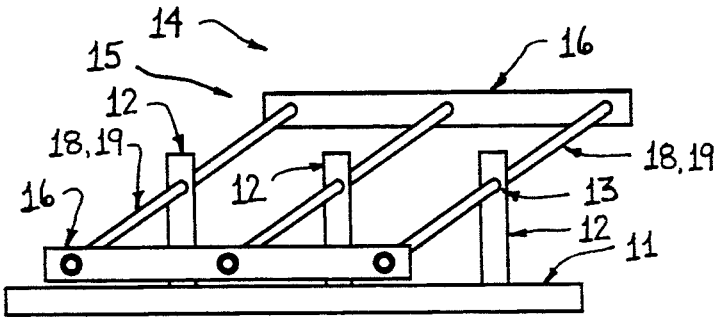
FIG. 3A is a side view of a third version of the foot operated rotational assembly.
Figure 3C:
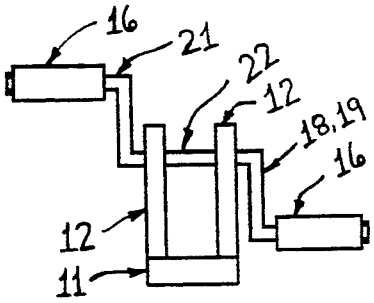
FIG. 3C is a front view of the third version.

FIGS. 3A, 3B, and 3C demonstrates a type of foot operated rotational assembly 14 which does not require a rotational assembly means 23. In this version, an additional shaft member 22 and connection members 27 are added. These additional components keep foot support member 16 at a substantially horizontal position, and shaft members 22 rotating in the same direction and at the same angular velocity and acceleration.

As seen in all the figures, at least two shaft members 22 are rotatably coupled to assembly supports 12 of frame structure 11 through structure openings 13. Fixedly attached to the end of each shaft member 22 are connection members 18, at least two per side. The connection members 18 on one side of the device are mounted at the same angle, while those on the opposite side are mounted at opposite angles to the previous ones. Each foot support member 16 loosely receives the second legs 21 of at least two connection members 18.

Since the connection members 18 are identical in lengths and shaft members 22 are mounted on assembly supports 12 at the same level, the foot support member 25 will be in a substantially horizontal position and remains so as long as shaft members 22 rotate in the same direction and at the same angular velocity and acceleration. This may be ensured by a rotational assembly means 23, or an additional shaft member 22 and connection member 18. In other words, the foot engagement members and the connection members are attached together along horizontal axes restricting relative movement to rotation about the axes.

Many variations of the foot operated rotational assembly exist and the configurations described above. For example, in all the above cases, the second leg is fixedly connected to the first leg, with the second leg being loosely connected to the foot support member. It is possible to loosely connect the first and second legs together and have the second leg rigidly connect to the foot support member. Also, in the version of the foot operated rotational assembly shown in FIGS. 3A, 3B, and 3C, it would be possible to have the shaft members rigidly mounted to the base, and the first leg of the connection member rotatable coupled to this shaft member. These variations would also allow the device to function as desired. While it will be apparent that the preferred embodiment of the invention herein disclosed is well-calculated to fulfill the objects above stated, it will be appreciated that the invention is susceptible to modification, variation, and change without departing from the proper scope or fair meaning of the subjoined claims.

I claim:

1. A foot engageable rotational assembly comprising:

a frame structure;

a rotation assembly mounted on said frame structure, wherein said rotation assembly includes at least two rotatable members, said rotatable members being operatively connected together by an intermediate rotatable member, said intermediate rotatable member being in rolling contact with said rotatable members, thereby causing said rotatable members to rotate at the same angular velocity and acceleration; and foot engagement means connected to said rotational assembly, wherein said foot engagement means includes connection members and two foot engaging members, each of said foot engaging members being connected to one side of each of said rotatable members through said connection members such that both foot engaging members remain in a substantially horizontal position as the rotatable members rotate, said foot engaging members and said connection members being attaches along horizontal axes restricting relative movement to rotation about said axes;

whereby a user may perform a cycling routine while in a standing position.

2. A foot engageable rotational assembly according to claim 1, wherein said rotatable members and said intermediate rotatable member together comprise a gear assembly.

3. A foot engageable rotational assembly according to claim 2, wherein each of said foot engaging members comprises a substantially flat top surface and sleeve openings spaced along a side surface to receive said connection members, and each of said connection members is a substantially L-shaped rod having a first and second leg, said first leg including means for rigid attachment to one of said rotatable members, and second leg including means for attachment with one degree of freedom to one of said foot engaging members.

* * * * *